United States Patent [19]

Howerton

[11] Patent Number: 5,027,516

[45] Date of Patent: Jul. 2, 1991

[54] MANUALLY HELD TOOL FOR CUTTING V-BELT BODIES AND METHOD OF CUTTING

[75] Inventor: Anderson W. Howerton, Nixa, Mo.

[73] Assignee: Dayco Products, Inc., Dayton, Ohio

[21] Appl. No.: 467,707

[22] Filed: Jan. 18, 1990

[51] Int. Cl.[5] ..... B26B 1/00; B26B 1/04; B26B 3/00; B26B 3/03

[52] U.S. Cl. ..... 30/335; 30/329; 83/54; 83/935

[58] Field of Search ..... 30/329, 332, 335; 29/414, 417; 51/78, 281 R, 79; 83/54, 178, 422, 935

[56] References Cited

U.S. PATENT DOCUMENTS

| | | | |
|---|---|---|---|
| 1,616,040 | 2/1927 | Gulliver | 30/332 |
| 2,833,032 | 5/1958 | Aciego | 30/329 |
| 3,430,339 | 3/1969 | Hobson | 30/329 |
| 3,488,843 | 1/1970 | Tims, Jr. | 30/332 |
| 3,621,570 | 11/1971 | Kolde et al. | 30/335 |
| 3,818,576 | 6/1974 | Braden et al. | 29/414 |
| 4,322,916 | 4/1982 | Richmond | 51/78 |
| 4,368,656 | 1/1983 | Howerton et al. | 83/178 |
| 4,437,371 | 3/1984 | Howerton et al. | 83/54 |
| 4,554,850 | 11/1985 | Edgar et al. | 83/935 |

*Primary Examiner*—Douglas D. Watts
*Assistant Examiner*—Paul M. Heyrana, Sr.
*Attorney, Agent, or Firm*—Joseph V. Tassone

[57] ABSTRACT

A manually held tool for cutting a polymeric endless power transmission belt body having alternating ribs and grooves; the tool comprising a pair of holding members for holding knife blades, and a handle around the holding members. The holding members are angled to fit within the grooves, and taper from the body to the tip, each end of the members have a different tip thickness and either end may hold a knife blade to fit belt body grooves of different thicknesses and permit cutting through selected grooves to form a plurality of endless belts having at least one rib. The tool is particularly adapted to cut belt bodies in an environment lacking in special machinery so that an operator can hold the body manually while performing the cutting operation.

13 Claims, 3 Drawing Sheets

MANUALLY HELD TOOL FOR CUTTING V-BELT BODIES AND METHOD OF CUTTING

BACKGROUND OF THE INVENTION

1. Field of the Invention

This invention relates to a manual tool for slitting a polymeric endless power transmission belt body which has a plurality of endless V-belt elements by cutting between immediately adjacent elements to define a plurality of endless belts each having at least one belt element. It also relates to the method of performing the manual cutting.

2. Prior Art Statement

Endless power transmission belts made primarily of polymeric material are widely used in industry and there are many types of such belts including, for example, belts consisting of a single belt element and belts consisting of a plurality of belt elements which are fastened together as a unitary structure in spaced side-by-side relation and referred to as multiple-element belts. These multiple-element belts are of two main types, i.e., ribbed belts and banded belts.

However, regardless of whether such polymeric belts are of the single element or multiple element type, they are usually cut from belt sleeves each having a large number of belt elements; and, numerous power driven belt cutting machines are known in the art and used to cut such belt sleeves.

Multiple elements belts, such as banded belts, are used in applications where it is necessary to transmit large loads or forces and often require a plurality of from two to six elements in a particular banded belt. However, it is costly for a local operator, such as a warehouse operator, belt distributor, or field user to provide an inventory of banded belts of each size and having two, three four, five, and six belt elements. Accordingly, it would be desirable to stock each particular size of banded belts which is used most often in its maximum number of available belt elements and then cut same to define a banded belt having the required lesser number of elements for a specific application. It would be particularly desirable to provide the cutting without the need for special machinery.

As indicated above, power driven belt cutting machines for cutting belt sleeves are known and could be used by a local operator to provide the above-described cutting. Similarly, power driven machines of various types have also been proposed for cutting multiple element banded belts. However, such machines are expensive and basically impractical for a local operator. Typical cutting machines of this type are described in U.S. Pat. No. 3,818,576 issued to Braden et al; and U.S. Pat. No. 4,322,916 issued to Richmond.

It has also been known to hold the cutting member in a fixed position and to move the belt body against the member to accomplish the desired cut. One such arrangement is described by Howerton et al in U.S. Pat. Nos. 4,368,658 and 4,437,371 (division), utilizing a pair of rotatable wheels which fit in the grooves of the belt body and hold the knife blade between them. This assembly is mounted on a fixed support station.

U.S. Pat. No. 4,554,850, issued to Edgar et al, provides a knife blade held in a body which is supported on a movable carriage means to perform the cut when the belt body is moved toward the blade. The knife body is designed to fit within the belt body grooves in a manner similar to Howerton, et al.

SUMMARY OF THE INVENTION

The principal feature of the present invention resides in providing a manually held tool for cutting a polymeric endless power transmission belt body having alternating ribs and grooves so that a plurality of endless belts are formed having at least one rib each. The novel tool comprises a pair of holding members which retain the actual cutting blade, and a handle around the holding members by which the tool is held. The holding members are tapered to fit within the grooves to provide support while cutting.

A further feature of the invention provides for each end of the holding members to be formed of a different tip thickness to conform with belt body grooves of different widths, capable of holding a knife blade at either end in an operative position.

Another feature of the invention provides for the use of the novel tool in an environment lacking in special machinery, so that the operator can manually hold the belt body and perform the cutting.

Other objects, features, uses, details and advantages of the present invention will become apparent from the embodiments presented herein, with references to the following specification, drawings, and claims.

BRIEF DESCRIPTION OF THE DRAWINGS

The accompanying drawings illustrate the preferred embodiment of the invention, in which.

DETAILED DESCRIPTION

Figure 1:
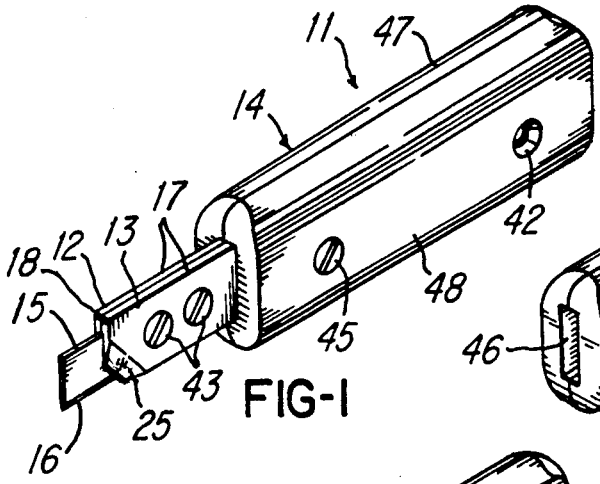
FIG. 1 is an isometric view of the novel cutting tool in one operative position.

Referring now to the drawings, the cutting tool is designated by reference numeral 11 and consists of a pair of holding members 12 and 13 retaining knife blades 15 and 15A at the ends thereof, and a handle 14 retaining the holding members. The holding members 12 and 13 are preferably made of a metal providing a minimum of friction, such as polished brass, but may also be made of a hard plastic material such as nylon, ABS or polycarbonate which may have friction reducing fillers incorporated therein. The handle 14 is preferably made of nylon, ABS. polycarbonate, or a similar material. The knife blades 15 and 15A are conventional steel blades of the type commercially available for cutting all types of materials, by means of sharpened edges 16 and 16A.

The holding member 12 is made of an elongated strip of material having a continuous flat upper surface 17 and angled at its ends 18 and 19 inwardly toward flat lower surface 20 to form angled end surfaces 21 and 22. The angled surfaces are also tapered inwardly from one side surface 23 toward the other side surface 24 to form a tapered surface 25 at end 18, and tapered surface 26 at end 19. The amount of taper is approximately 20° at each end. However, the surface 25 and side 23 at end 18 form a tip 27 having a thickness of approximately 0.025 inch; and the surface 26 and side 23 at end 19 form a tip 28 which is approximately 0.050 inch. The holding member 13 is similar to member 12, except that it is a mirror image of member 12. Upon assembly of the tool the side surfaces 23 of each member will face each other, and the tapered surfaces 25 at the ends 18 of both holding members will be oppositely and outwardly facing. Similarly, the tapered surfaces 26 at the ends 19 of both holding members will also be oppositely and outwardly facing. The reference numbers applied to member 12 are also applicable to member 13.

When the tool 11 is assembled, the knife blade 15 is placed between the surfaces 23 of the holding members with the edge 16 facing downwardly, the end of the blade extending beyond the tips 27 of the end 18. A slotted opening 29 in the blade is aligned with openings in the holding member, which are aligned with each other. Similarly, the knife blade 15A is placed between the holding members with the end of the blade extending beyond tips 28 of end 19. Holding member 13 has four countersunk openings 30, 31, 32 and 33, which are aligned with four tapped and threaded openings 34, 35, 36 and 37 in holding member 13. In order to mount knife blade 15, a air of flat head machine screws 43 are inserted through openings 30 and 31, through slot 29, and threaded into the openings 34 and 35 to secure the blade between the holding members. Similarly, blade 45 is mounted by inserting another pair of screws 43 through openings 32 and 33, through slot 29, and threaded into openings 36 and 37 to secure that blade in the same manner.

The handle 14 is formed of two similar handle halves 47 and 48. Handle half 47 has openings 38 and 39, into which are pressed threaded inserts 40. Handle half 48 has two countersunk openings 41 and 42 which are aligned with these inserts. In order to assemble the tool, the handle halves are placed around the holding members, which fit within recesses 46. A flathead screw 45 is inserted through opening 41 of the handle, through central opening 44 of the holding members; and threaded into the insert 40 pressed into opening 38. The screw is tightly threaded so that its flat surface is flush with the outer surface of the handle half 48. The assembly is thus completed as shown in FIG. 1. The tips 27 of the ends 18 of the holding members are tapered to form an included angle of approximately 40°, and have a width of approximately 0.050 inch. In this position the knife blade 15A and ends 19 of the holding members are covered by the handle.

When it is desired to mount the knife blade at the other ends 19 of the holding members, the screw 45 is removed and the handle halves are slid toward ends 18 so that ends 19 are exposed, as well as the other knife blade 15A. The screw 45 is then inserted through openings 42 and 44 and threaded into insert 40 in opening 39 to provide the assembly shown in FIG. 3. In this arrangement, the tips 28 of ends 19 also provide an included angle of approximately 40°, but these tips have a width of approximately 0.100 inch, compared to 0.050 of ends 18. The knife blade 15 and ends 18 are now covered.

METHOD OF OPERATION

One of the important features of the novel cutting tool is its adaptability for use in separating belt bodies into belts of pre-determined widths after the bodies are shipped from the factory to a distributor, wholesaler, or even the eventual customer. In such establishments there will be no special machines for use in conjunction with cutting the bodies, so an individual must be able to cut the desired belt by hand. To do this, he must be able to support the belt body from at least two points within the inner periphery, and move the cutting tool around the groove to sever or slit the body between adjacent ribs.

Figure 4:
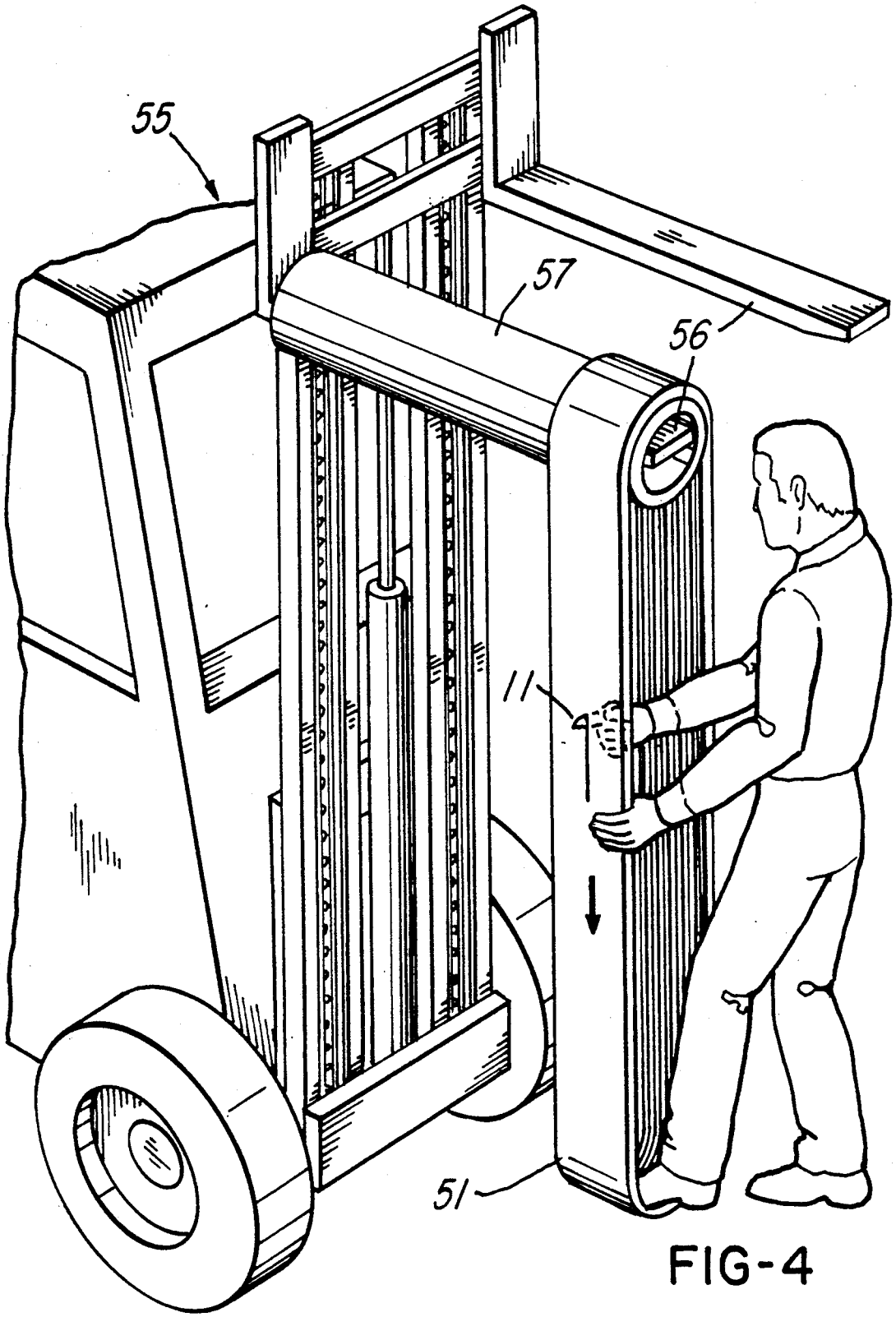
FIG. 4 is an isometric view illustrating an exemplary method of cutting the belt body without the use of special machinery.
Figure 5:
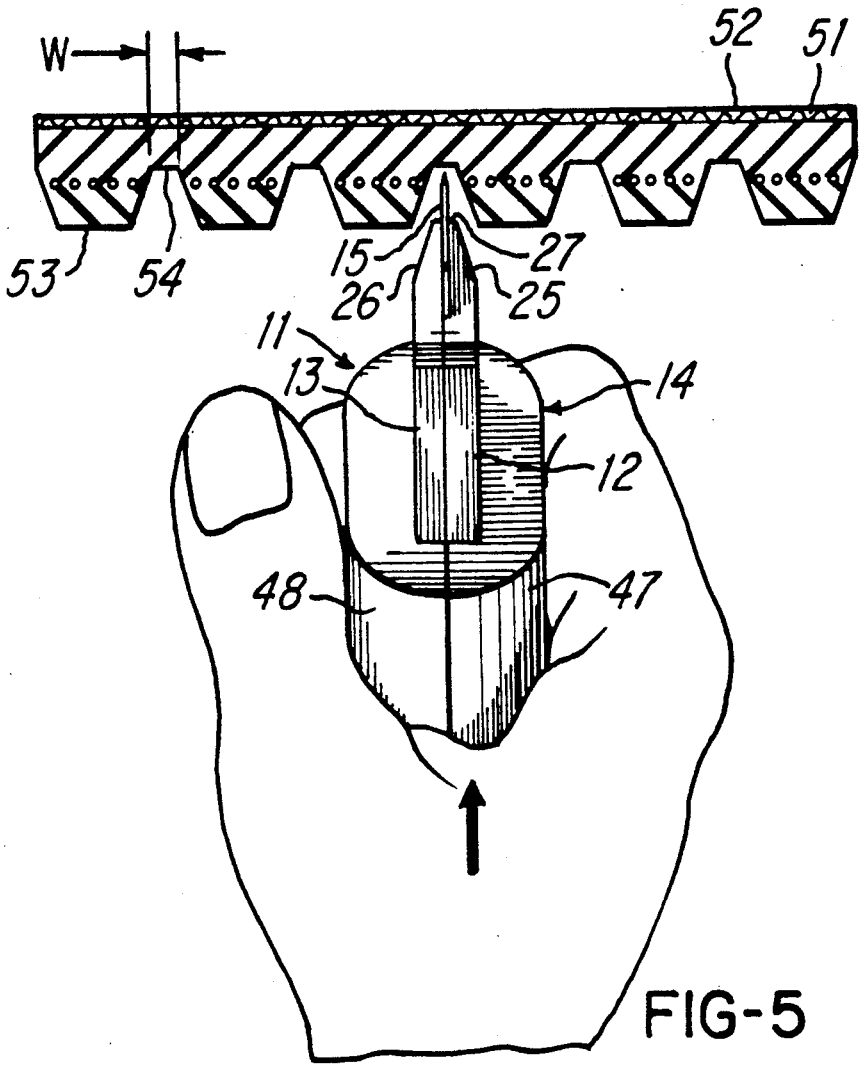
FIG. 5 is an end view of the belt body with the cutting tool shown at the beginning of its cutting position, and a portion of mechanism for rotating the belt body.

A typical example of such an operation is illustrated in FIG. 4 wherein the operator utilizes a fork lift truck 55 having a fork 56 over which a length of pipe 57 preferably about five inches in diameter is placed. The belt body 51 is hung over the pipe to support the upper portion thereof, and the operator merely steps on the lower diametrically opposite portion to hold it taut. He then holds the cutting tool in one hand and places it into a selected groove and then manually passes the knife blade through the groove to cut completely through the body, using his other hand to rotate the body as required to make the cut along the entire length of the groove. If the belt body is sufficiently taut by virtue of its weight, the operator may not need to step on the lower portion. The relationship of the cutting tool is shown in detail in FIG. 5, wherein a segment of the belt body 5 is shown.

The integral part of the body is tie band 52, to which is secured alternating ribs 53 and grooves 54. The grooves are tapered inwardly toward the tie band, and have a minimum width W at the tie band.

The cutting tool is held in place by hand, preferably at an angle of about 45° to the band, and gradually forced upward into the selected groove 54 to cut the belt body apart at that groove, in order to provide a belt having the desired number of ribs. As indicated above, the end 18 forms tips 27 whose width is 0.050 inch, which conforms to width W of the belt body grooves. The width W conforms with Standard groove widths for belts designated by the Rubber Manufacturers Association and the Mechanical Power Transmission Association as R3V, R5V, RB and RC. The angled sides of the grooves are slightly less than the 40° taper angle of the holding member tips ranging from about 34° to 38°, but readily supporting the tips to provide accurate positioning of the cutting blade centrally of the groove. The tip width thus conforms with the groove width W when the tool is inserted into the grooves.

Figure 3:
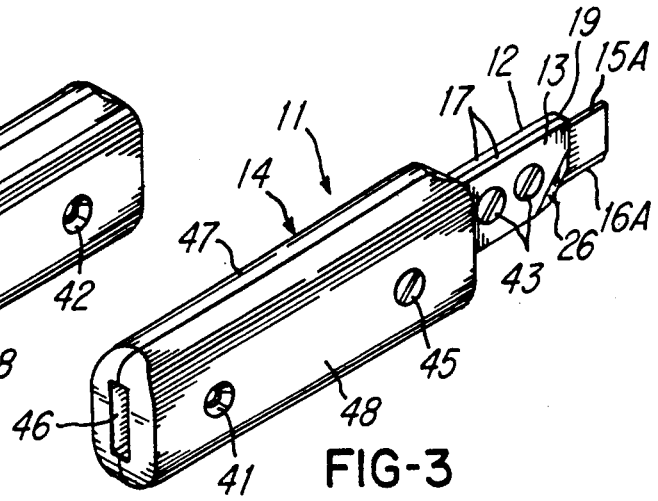
FIG. 3 is a view similar to FIG. 1 with the cutting tool in the other operative position.
Figure 2:
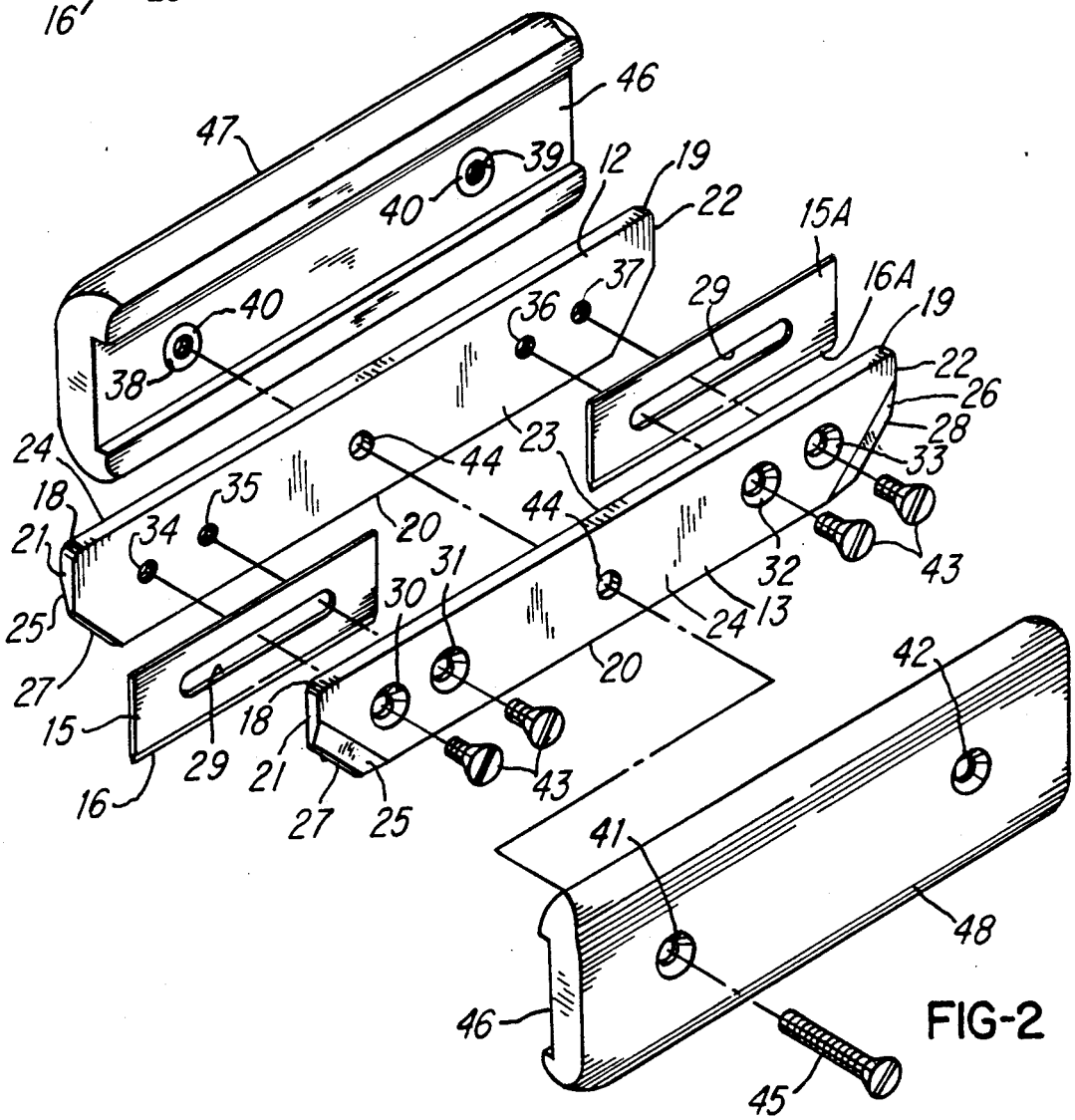
FIG. 2 is an exploded isometric view of the novel cutting tool of FIG. 1.

When the tool is placed into the FIG. 3 position, the cutting operation is the same, except that tips 28, having a width of 0.100 inch, are utilized. This time the belts designated as R8V and RD are cut, these grooves having dimension W which conforms to this width. The belt body 51 illustrated is a banded belt having only a common tie band 52 to provide the unitary construction. As discussed above, however, the cutting operation equally applies to ribbed belts formed from ribbed belt bodies; both ribbed belts and banded belts falling in the general category of multiple-element belts.

The operation shown in FIG. 4 will normally be used with large and heavy belt bodies so that the fork lift takes the weight of the body during cutting. However, if a belt body is smaller and lighter in construction, it may not be necessary to use the fork lift truck. Instead the operator holds the upper portion of the belt body with one hand, for example the left hand if he is right-handed; and steps on the inside of the body to hold it taut. He then operates the tool with his right hand to cut in the manner described above, and rotates the body with his left hand while continuing the cut through the selected groove.

The novel cutting tool thus provides manual holding means for selectively cutting a belt body into a plurality of endless belts, having selectively operative cutting blades at opposite ends thereof.

While present exemplary embodiments of this invention, and methods of practicing the same, have been illustrated and described, it will be recognized that this invention may be otherwise variously embodied and practiced within the scope of the following claims.

I claim:

1. In a means for cutting a polymeric endless power transmission belt body having a plurality of endless V-belt elements having alternating ribs and grooves, means for supporting {and moving} said belt body relative to said cutting means, the improvement wherein said cutting means comprises a manually held cutting tool for cutting said belt body to form a plurality of endless belts having at least one rib, said cutting tool disposed within a selected one of said grooves for cutting therethrough, said tool comprising a cutting knife blade, a pair of non-cutting members holding said blade, and a handle around said holding members to provide manual holding of said tool, said holding members having facing ends which are oppositely and outwardly tapered to a tapered tip to fit within said selected one of said grooves and contact the sides thereof.

2. The tool of claim 1 wherein said grooves are tapered to form a minimum width at their base, the width of said holding members approximately equal to said minimum width of said grooves.

3. The tool of claim 1 wherein one end of said holding members forms a given width at the tip thereof, and the other end forms a different width at the tip thereof.

4. The tool of claim 3 comprising a separate knife blade at each end of said holding members, each of said knife blades being selectively placed in one of said grooves for cutting therethrough.

5. The tool of claim 3 wherein one of said ends have a width of 0.050 inch at its tip.

6. The tool of claim 3 wherein one of said ends has a width of 0.100 inch at its tip.

7. The tool of claim 1 wherein said holding members have opposite outer surfaces which converge at an included angle of approximately 40°.

8. The tool of claim 1 wherein said tool is held at an angle of approximately 45° to the direction of driving said belt body for cutting therethrough.

9. In a method for cutting a polymeric endless power transmission belt body having a plurality of endless V-belt elements having alternating ribs and grooves, the improvement comprising the steps of supporting the belt body, {manually} placing a cutting tool into a selected one of said grooves, manually passing said tool through said groove to cut completely through said belt body, and manually {causing relative motion between said belt body and} moving said belt body against said tool to {sever} slit said belt body between adjacent ribs.

10. The method of claim 9 wherein said supporting step comprises supporting said belt body from at least two diametrically opposite points.

11. The method of claim 9 wherein said steps are performed by a human operator having two hands, said operator holding said cutting tool in one hand and supporting said belt body in his other hand.

12. The method of claim 11 wherein said operator holds said cutting tool within said groove and rotates said belt body by means of his said other hand to slit said belt body.

13. The method of claim 9 including the steps of providing a human operator having two hands and two feet, supporting said belt body from a fixed support, said operator placing one of said feet at a point diametrically opposite from said fixed support, to keep said belt fairly taut, said operator holding said cutting tool in one hand and placing it into and through said selected channel, and said operator manually rotating said belt body while maintaining said cutting tool and said foot in their relatively same positions to slit said belt body.

* * * * *